US008362868B2

(12) United States Patent
Tamura et al.

(10) Patent No.: US 8,362,868 B2
(45) Date of Patent: Jan. 29, 2013

(54) PLANE COIL

(75) Inventors: Hideki Tamura, Moriyama (JP); Tomohiro Ota, Takarazuka (JP); Kyohei Kada, Hikone (JP); Masayuki Suzuki, Otsu (JP)

(73) Assignee: Panasonic Corporation, Osaka (JP)

( * ) Notice: Subject to any disclaimer, the term of this patent is extended or adjusted under 35 U.S.C. 154(b) by 58 days.

(21) Appl. No.: 13/001,675

(22) PCT Filed: Jun. 22, 2009

(86) PCT No.: PCT/JP2009/061296
§ 371 (c)(1),
(2), (4) Date: Dec. 28, 2010

(87) PCT Pub. No.: WO2010/001749
PCT Pub. Date: Jan. 7, 2010

(65) Prior Publication Data

US 2011/0102125 A1 May 5, 2011

(30) Foreign Application Priority Data

Jul. 4, 2008 (JP) ..... 2008-175741

(51) Int. Cl.
*H01F 27/28* (2006.01)
*H01F 5/00* (2006.01)

(52) U.S. Cl. ..... 336/232; 336/200

(58) Field of Classification Search ..... 336/200, 336/223, 232
See application file for complete search history.

(56) References Cited

U.S. PATENT DOCUMENTS

| | | | | | |
|---|---|---|---|---|---|
| 2,622,238 | A | * | 12/1952 | Boltson | 323/355 |
| 3,139,566 | A | * | 6/1964 | Marley | 335/210 |
| 3,242,404 | A | * | 3/1966 | Favre | 318/400.37 |
| 3,419,834 | A | * | 12/1968 | McKechnie et al. | 336/69 |
| 4,075,591 | A | * | 2/1978 | Haas | 336/200 |
| 5,391,392 | A | * | 2/1995 | Kitagawa | 427/81 |
| 5,874,704 | A | * | 2/1999 | Gates | 219/121.43 |

(Continued)

FOREIGN PATENT DOCUMENTS

| | | |
|---|---|---|
| JP | 4-122007 | 4/1992 |
| JP | 4-134822 | 12/1992 |

(Continued)

OTHER PUBLICATIONS

Japan Office action, dated Mar. 8, 2011 along with an english translation thereof.

(Continued)

*Primary Examiner* — Mohamad Musleh
*Assistant Examiner* — Joselito Baisa
(74) *Attorney, Agent, or Firm* — Greenblum & Bernstein, P.L.C.

(57) ABSTRACT

A plane coil which reduces an increase of an effective resistance in a high-frequency area and is made thinner is provided. The plane coil is equipped with plural conductive wires which are parallel to each other, wherein the conductive wires are arranged in a plane and spirally wound, and coil ends of the respective conductive wires are electrically connected to each other at coil lead-out portions and thus are connected in parallel. The conductive wires are arranged in plane, so that a coil thickness does not increase, and the coil is made thinner. Moreover, the plural conductive wires are connected in parallel, an increase of an effective resistance due to an influence of a skin effect in a high-frequency area is reduced.

4 Claims, 10 Drawing Sheets

U.S. PATENT DOCUMENTS

| | | | | |
|---|---|---|---|---|
| 5,966,063 | A | 10/1999 | Sato et al. | |
| 6,307,457 | B1 * | 10/2001 | Wissink et al. | 336/200 |
| 6,577,219 | B2 * | 6/2003 | Visser | 336/200 |
| 6,580,334 | B2 * | 6/2003 | Simburger et al. | 333/24 R |
| 6,798,326 | B2 * | 9/2004 | Iida | 336/200 |
| 7,274,281 | B2 * | 9/2007 | Sugioka | 336/170 |
| 7,671,714 | B2 * | 3/2010 | Tiemeijer | 336/200 |
| 7,932,801 | B2 * | 4/2011 | Loef | 336/200 |
| 2001/0033204 | A1 | 10/2001 | Simburger et al. | |
| 2004/0240126 | A1 | 12/2004 | Tiemeijer | |
| 2009/0195343 | A1 | 8/2009 | Tiemeijer | |

FOREIGN PATENT DOCUMENTS

| | | |
|---|---|---|
| JP | 6-29117 | 4/1994 |
| JP | 6-029117 | 4/1994 |
| JP | 09-134820 | 5/1997 |
| JP | 9-134820 | 5/1997 |
| JP | 2003-510806 | 3/2003 |
| JP | 2004-538631 | 12/2004 |
| JP | 2005-327834 | 11/2005 |
| JP | 2006-42519 | 2/2006 |
| JP | 2007-324532 | 12/2007 |
| JP | 2008-503890 | 2/2008 |
| JP | 2008-087733 | 4/2008 |
| WO | 98/43258 | 10/1998 |

OTHER PUBLICATIONS

China Office action, mail date is Apr. 18, 2012.

* cited by examiner

PLANE COIL

FIELD OF THE INVENTION

The present invention relates to a plane coil which is used in a non-contact power transmission device, etc.

DESCRIPTION OF THE RELATED ART

Conventionally, as described in Japanese Laid-Open Patent Publication No. 2006-42519, for example, a non-contact power transmission device which uses an electromagnetic induction effect of a coil is suggested as a non-contact transmission technology. FIG. 15 shows such a device. A non-contact transmission device 80 includes a power transmitting coil 81S and a power receiving coil 81R which face with each other (referred to as the coil 81 hereinafter). When alternating current is applied to the power transmitting coil 81S, electrical power is transmitted to the power receiving coil 81R by the electromagnetic induction effect. FIGS. 16A and 16B show a shape of a plane coil used in the coil 81. A plane coil 82, in which the coil is spirally and planarly configured, is made thinner.

In general, in order to make the non-contact transmission device 80 small, the coil 81 is made small and used at a high frequency of tens to hundreds of kHz. FIG. 17 shows a frequency characteristic of an effective resistance of this type of coil. When one single copper wire is wound to form the coil, the effective resistance increases in a high-frequency area due to an influence of a skin effect and a proximity effect, and a transmission efficiency of the electrical power decreases.

In order to avoid the increase of the effective resistance in the high-frequency area, a coil which is formed by winding a litz wire is used for the coil 81. FIG. 18 shows a cross sectional configuration of a litz wire 83. The litz wire 83 is generally made up by bundling and twisting plural copper wires 84 of small outside diameter. Accordingly to the above configuration, a total surface area of the wire 84 become larger, and the litz wire 83 controls the increase of the effective resistance in the high-frequency area (refer to FIG. 17).

However, when applying the litz wire 83 to the plane coil 82, an outside diameter of the wound wire becomes large by reason that the litz wire 83 is made up by winding the plural wires, and plane coil 82 is prevented from being thin.

From a point of view of the transmission efficiency of the electrical power, it is preferable that the coil 81 has the coil of large outside diameter. When using the litz wire 83 for the coil 81, it is necessary to wind the coil at least a required number of times or provide a space between the windings to ensure the coil outside diameter. FIG. 19 shows a plane coil 85 in which a space is provided between the windings of the litz wire 83. In this case, the plane coil 85 needs an unnecessary member to make a space, or the coil should to be wound while ensuring the space between the windings by a specific method.

In contrast, FIG. 20 shows a plane coil using a printed-wiring board. In a plane coil 86, a coil is made up by a copper foil pattern 88 in a printed-wiring board 87, and the plane coil 86 has a through hole 89 to lead out an inner end of the coil. The plane coil 86 has a large surface area of the copper foil pattern and thereby, there is little increase of the effective resistance in the high-frequency area. FIG. 21 shows an enlarged X area of the plane coil 86. The copper foil pattern 88 has a large eddy current 91 caused by a linking magnetic flux B, and as a width of the copper foil pattern 88 gets larger, an eddy-current loss increases.

PRIOR ART DOCUMENT

Patent Document

Patent document 1: Japanese Laid-Open Patent Publication No. 2006-42519

SUMMARY OF THE INVENTION

Problems to be Solved by the Invention

The present invention is to solve the problem described above, and an object of the present invention is to provide a plane coil which is made thinner and reduces an increase of an effective resistance in a high-frequency area.

Means of Solving the Problems

To achieve the object described above, the present invention provides a plane coil equipped with plural conductive wires which are parallel to each other, wherein the conductive wires are arranged in a plane and spirally wounded, and coil ends of the respective conductive wires are electrically connected to each other at a coil lead-out portion and thereby the wires are connected in parallel.

According to the above configuration, the conductive wires are arranged in a plane, so that a coil thickness does not increase but is made thinner. Moreover, the plural conductive wires are connected to each other in parallel, so that an increase of an effective resistance due to an influence of a skin effect in a high-frequency area is reduced.

It is preferable that in the invention described above, an arrangement of inner and outer peripheries of the conductive wires, which are connected in parallel, are changed on a way the winding of the conductive wires.

According to the above configuration, the arrangement of the inner and outer peripheries of the conductive wires, which are connected in parallel, are changed on the way of the winding of the conductive wires, so that a generation of a loop current is avoided and a coil loss is controlled, and when using for a non-contact power transmission, an efficiency of the power transmission is improved.

It is preferable that in the invention described above, the arrangement of the conductive wires is changed even number of times per turn.

According to the above configuration, the arrangement of the conductive wires is changed even number of times per turn, so that an influence of a coil diameter change due to a spiral shape is reduced, and the loop current is offset with high accuracy.

It is also preferable that in the invention described above, changing positions of the plural conductive wires are not lined up each other.

According to the above configuration, the changing positions are not lined up each other appropriately, so that the changing positions are not focused in one position, and an increase of thickness caused by the changing is suppressed minimally.

It is also preferable that in the invention described above, the plane coil has a configuration that the conductive wires whose number of coils is an even multiple of coils connected in parallel are wound a predetermined number of turns divided by the even number and the conductive wires whose arrangement of the inner and outer peripheries are different from each other are connected in series in a coil lead-out portion to have the predetermined number of turns, and coil ends of the respective conductive wires are connected to each other in parallel in a coil lead-out portion.

According to the above configuration, the arrangement of the conductive wires is changed at the coil lead-out portion, so that it is not necessary to change the arrangement of the conductive wires in the wound coil, and thus the thin plane coil can be configured easily.

It is also preferable that in the invention described above, the plane coil has a configuration that even numbers of coils which have equal coil diameters or equal number of turns at least are stacked, and an arrangement of the conductive wires whose arrangement of the inner and outer peripheries are different from each other are changed between the coils and then those conductive wires are connected in series.

According to the above configuration, the arrangement of the conductive wires are changed between the coils, so that it is not necessary to change the arrangement of the conductive wires in the wound coil, and the coil is easy to wind.

It is also preferable that in the invention described above, the conductive wire can be a copper wire.

According to the above configuration, the plane coil is made thinner by using the thin copper wire.

It is also preferable that in the invention described above, the conductive wire can be made up of a copper foil pattern.

According to the above configuration, the plural wirings of the copper foil pattern are connected in parallel, so that a width of each wiring can be thin, and an eddy current is reduced.

It is also preferable that in the invention described above, the copper wire is made up of a litz wire.

According to the above configuration, the plural litz wires are arranged in a plane and spirally wound, so that a coil diameter required for the plane coil is ensured.

BRIEF DESCRIPTION OF THE DRAWINGS

The present invention will be described below with reference to the annexed drawings. It is to be noted that all the drawings are shown for the purpose of illustrating the technical concept of the present invention or embodiments thereof, wherein.

DESCRIPTION OF THE PREFERRED EMBODIMENTS

Figure 1A:
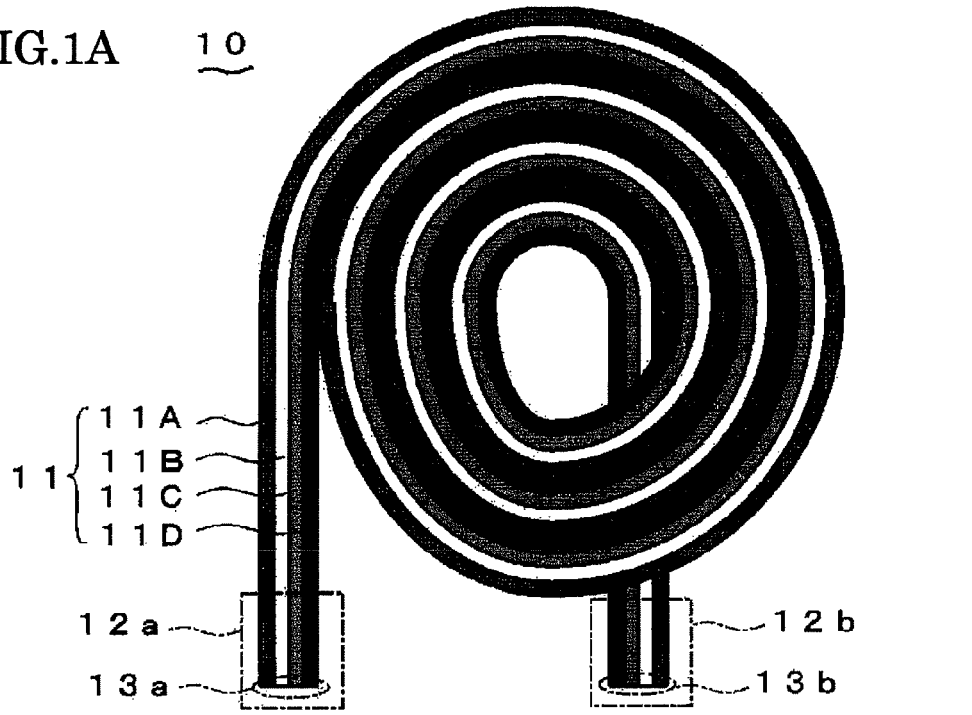
FIG. 1A is a plane view of a plane coil according to a first preferred embodiment of the present invention and FIG. 1B is a lateral view of the plane coil in FIG. 1A.
Figure 1B:
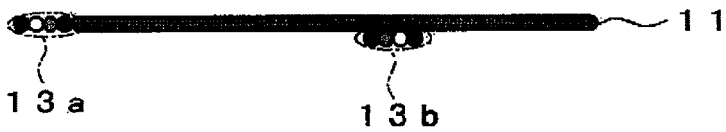

FIGS. 1A and 1B show a configuration of a plane coil 10 according to a first preferred embodiment of the present invention. The plane coil 10 is equipped with winding plural conductive wires 11A, 11B, 11C, and 11D (referred to as the conductive wires 11 hereinafter) which are parallel to each other spirally in a plane. Coil ends 13*a* and 13*b* of the conductive wires 11 are located at coil lead-out portions 12*a* and 12*b* of the plane coil 10. The conductive wires 11 are parallel connected in parallel by connecting the coil ends 13*a* of the respective parallel conductive wires 11 electrically at the coil lead-out portion 12*a* and connecting the opposite coil ends 13*b* electrically at the coil lead-out portion 12*b*. The conductive wires 11 are mutually-insulated between the coil end 13*a* and the coil end 13*b*. The number of the conductive wires 11 is not limited to four, however, at least two conductive wires are only required, and a diameter and number of the conductive wires are selected under a condition of an effective resistance value in a usable frequency and a coil diameter and a coil thickness of the plane coil 10.

Figure 2:
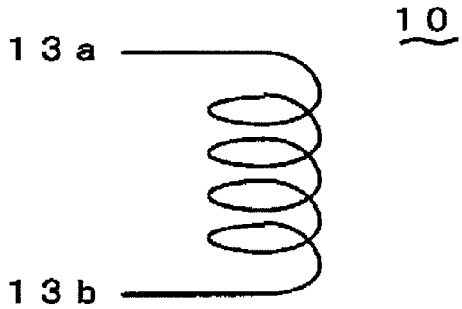
FIG. 2 is an equivalent circuit schematic of the plane coil in FIG. 1A.

FIG. 2 shows an equivalent circuit of the plane coil 10. A current flows in the coil when the current is applied between the coil ends 13*a* and 13*b* or a magnetic flux which links to the plane coil 10 is changed.

The plane coil 10 is formed by winding the linear conductive wires 11 on a winding bobbin (not shown), for example. The winding bobbin with a small space between bobbin side plates, which is slightly larger than the diameter of the conductive wires 11, is used, and the plural conductive wires 11 are caught between the bobbin side plates and wound up spirally. The conductive wires 11 are a self-bonding insulated wire in which a bonding material layer is provided around an enameled copper wire, for example. Polyvinyl butyral resin, copolymerized polyamide resin, or phenoxy resin, for example, is used as the bonding material. The self-bonding insulated wires are rapidly and easily bonded to each other by a heating treatment or a solvent processing. A spiral arrangement of the plane coil 10 is retained by bonding the conductive wires 11. The treated plane coil 10 is removed from the winding bobbin.

According to the plane coil 10 of the present preferred embodiment, the conductive wires 11 are arranged in a plane, so that a coil thickness does not increase but is made thinner. Moreover, the plural conductive wires 11 are connected to each other in parallel, so that an increase of an effective resistance due to an influence of a skin effect in a high-frequency area is reduced. Furthermore, the plural conductive wires 11 which are connected to each other in parallel are spirally wound, so that a coil diameter required for the plane coil is ensured easily.

Figure 3:
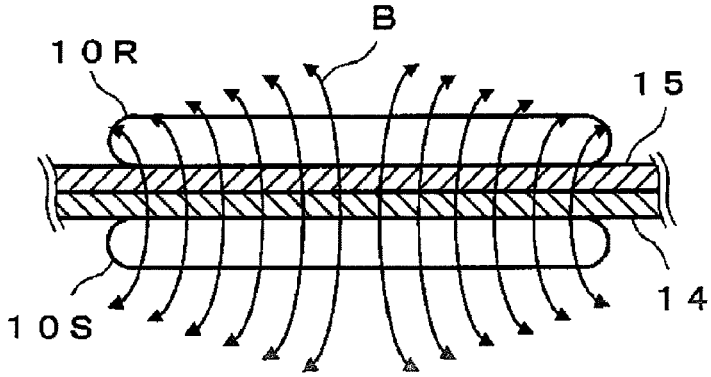
FIG. 3 is a lateral view showing a layout of the plane coil in FIG. 1A in a non-contact power transmission.

A non-contact power transmission using the above plane coil 10 is described below. FIG. 3 shows a layout of a plane coil in the non-contact power transmission. A power transmitting coil 10S and a power receiving coil 10R which are made up of the plane coil 10 of the present preferred embodiment is located so that they face with each other across a transmitting case 14 and a receiving case 15, for example. A magnetic flux B links to the power transmitting coil 10S and the power receiving coil 10R, and the electrical power is transmitted from the transmitting side to the receiving side.

Figure 4A:
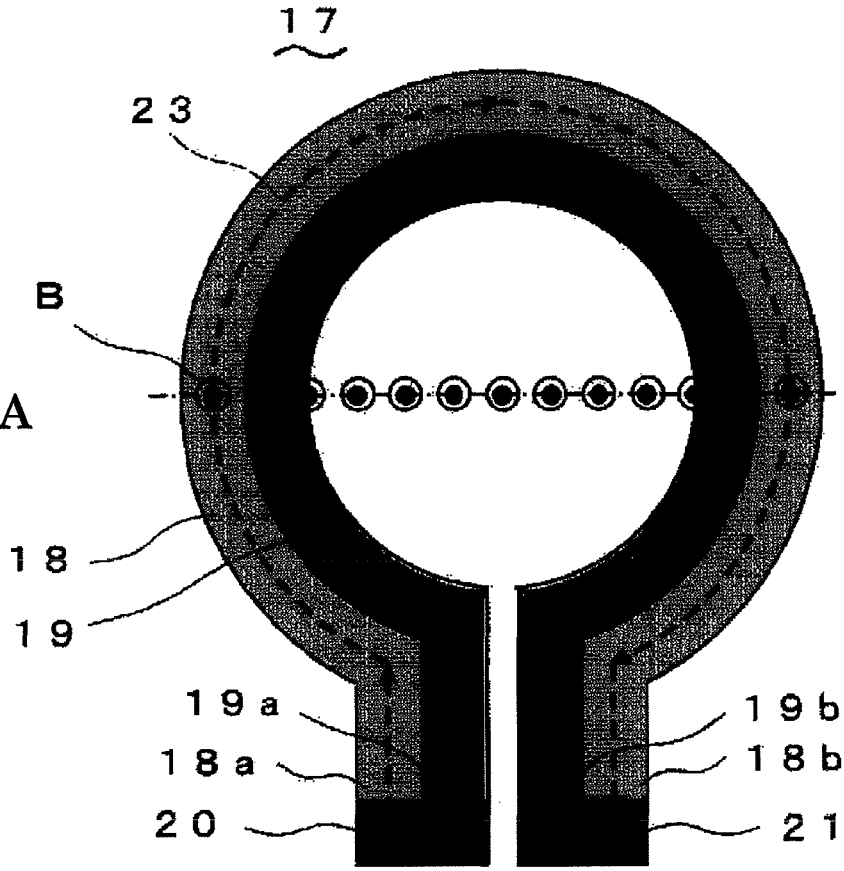
FIG. 4A is a plane view showing magnetic flux linking to the plane coil according to a first preferred embodiment of the present invention and FIG. 4B is a lateral view showing the magnetic flux in FIG. 4A.
Figure 4B:
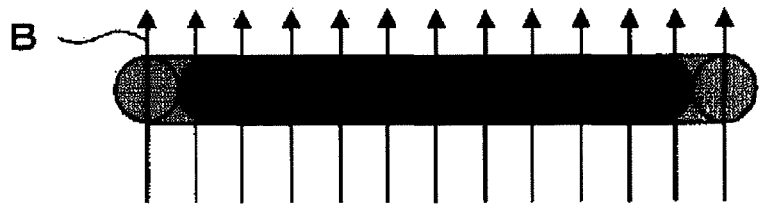

Next, the magnetic flux which links to the respective plane coils in the non-contact power transmission is described in detail by holding up a plane coil in which two conductive wires are wound one turn as an example. FIGS. 4A and 4B show the plane coil and the magnetic flux. The magnetic flux which is located outside of an outer periphery of the plane coil is not shown. In a plane coil 17, two parallel conductive wires 18 and 19 are arranged in a plane and wound one turn. Coil ends 18*a* and 19*a* of the conductive wires 18 and 19 are electrically connected to each other by soldering, for example, in a coil lead-out portion 20 of the plane coil 17, and coil ends 18*b* and 19*b* of are electrically connected to each other at a coil lead-out portion 21 in the same manner. When applying the current from the coil lead-out portions 20 and 21, the magnetic flux B links to the plane coil 17 and the electrical power is transmitted. In the magnetic flux B, the magnetic flux which does not contribute to the power transmission exists between the conductive wires 18 and 19 in addition to the magnetic flux which contributes to the power transmission. The magnetic flux B between the conductive wires 18 and 19 generates a loop current 23 on the conductive wires 18 and 19 which are connected in parallel. The loop current 23 causes a coil loss to the plane coil 17 and reduces a power transmission efficiency. Moreover, the loop current 23 increases a temperature of the plane coil 17, so that a heat release is necessary and a miniaturization of the non-contact power transmission device is avoided.

Figure 5:
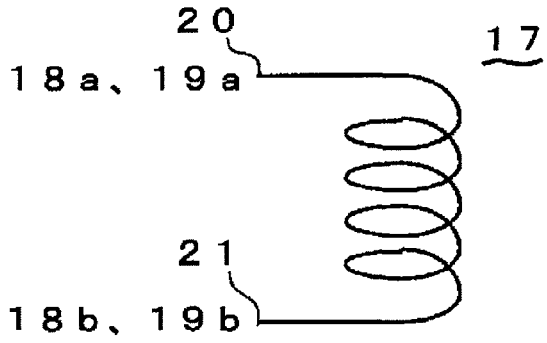
FIG. 5 is an equivalent circuit schematic of the plane coil in FIG. 4A.

FIG. 5 shows an equivalent circuit of the plane coil 17. The coil ends 18*a* and 19*a* on one side are electrically connected, the coil ends 18*b* and 19*b* on the other side are electrically connected, and a coil is formed between the both coil ends 18*a* and 19*a* and coil ends 18*b* and 19*b*.

Figure 6:
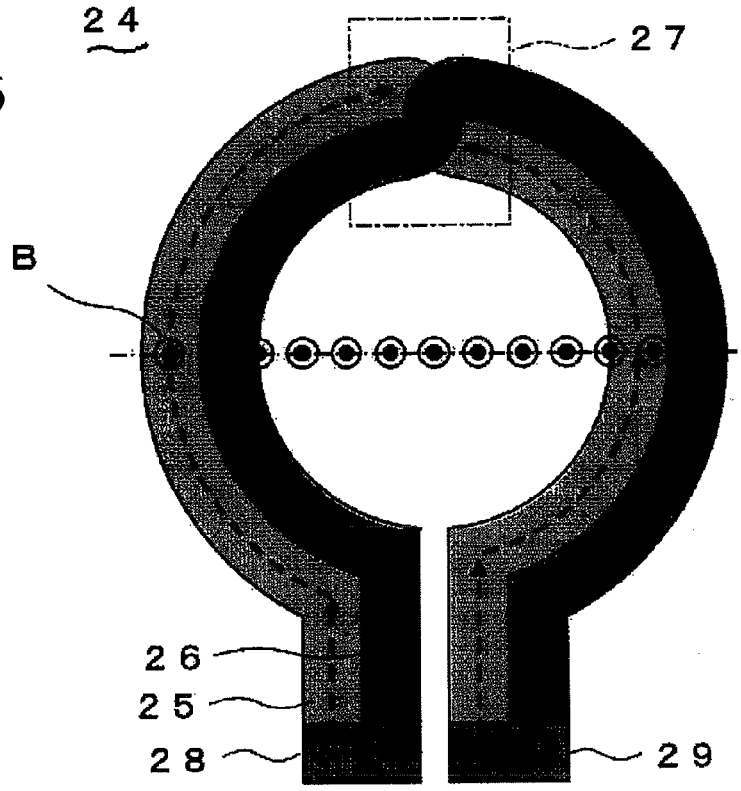
FIG. 6 is a plane view of a plane coil according to a second preferred embodiment of the present invention.

FIG. 6 shows a configuration of a plane coil 24 according to a second preferred embodiment of the present invention. The plane coil 24 has a configuration that an arrangement of inner and outer peripheries of conductive wires 25 and 26, which are connected in parallel, are changed in a changing portion 27 on a way of the winding of the conductive wires 25 and 26 in addition to the configuration similar to the first preferred embodiment. The conductive wires 25 and 26 are electrically connected in coil lead-out portions 28 and 29.

In the plane coil 24 having the above configuration, directions of the loop current flowing in the conductive wires 25 and 26 are opposite to each other, that is to say, the loop currents flow in opposite directions between the coil lead-out portion 28 and the changing portion 27 (a left side of the plane coil 24 in FIG. 6) and between the changing portion 27 and the coil lead-out portion 29 (a right side of the plane coil 24 in FIG. 6), so that the loop current is offset and thereby does not flow. It is preferable that the changing portion 27 is located so that wire lengths from the coil lead-out portions 28 and 29 are substantially the same with each other. According to the above configuration, a symmetry between the coil lead-out portions 28 and 29 and the changing portion 27 is improved and thus the loop current is offset with high accuracy.

As described above, according to the plane coil 24 of the present preferred embodiment, the arrangement of the inner and outer peripheries of the conductive wires 25 and 26, which are connected in parallel, are changed on the way of the winding of the conductive wires 25 and 26, so that the generation of the loop current is avoided and the coil loss is controlled, and when using for the non-contact power transmission, the efficiency of the power transmission is improved.

Figure 7:
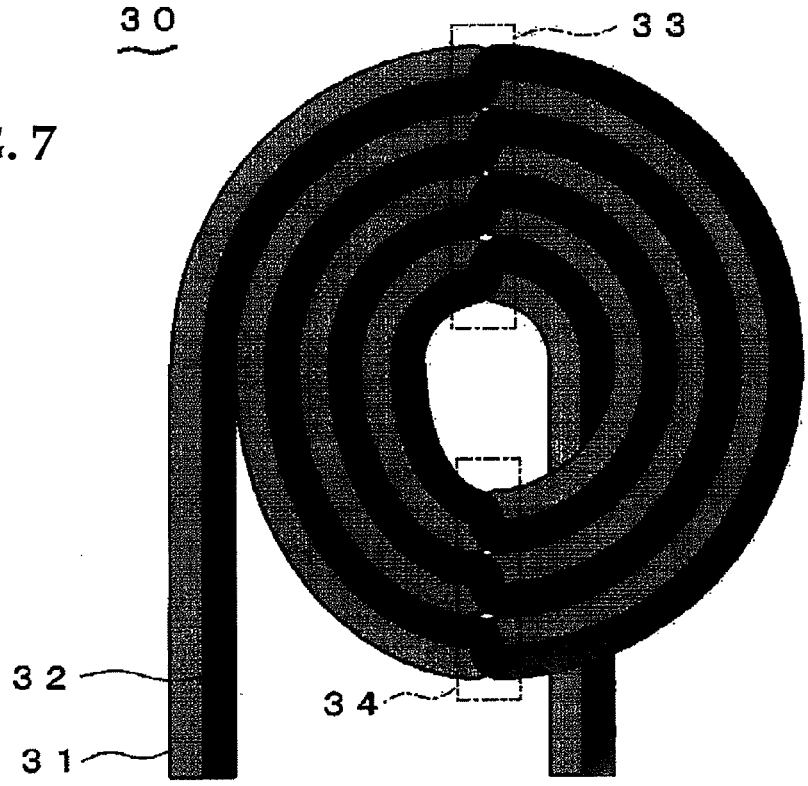
FIG. 7 is a plane view of a plane coil according to a third preferred embodiment of the present invention.

FIG. 7 shows a configuration of a plane coil 30 according to a third preferred embodiment of the present invention. The plane coil 30 has a configuration that an arrangement of conductive wires 31 and 32 are changed even number of times, twice at least, per turn in addition to the configuration similar to the second preferred embodiment. Coil ends of the conductive wires 31 and 32 are electrically connected, respectively (not shown: to be interpreted in the same way hereinafter). In the plane coil 30, the plural conductive wires 31 and 32 are spirally wound several number of turns, and an arrangement of inner and outer peripheries of conductive wires 31 and 32, which are connected in parallel, are changed in even-numbered changing portions 33 and 34. It is preferable that the even-numbered changing portions 33 and 34 are located substantially symmetrically with respect to a center of the plane coil 30.

In the plane coil having the plural turns, it is difficult to offset the loop current with high accuracy by changing the arrangement of the conductive wires once per turn due to a change of the coil diameter caused by the spiral shape. According to the plane coil 30 of the present preferred embodiment, the arrangement of the conductive wires 31 and 32 is changed even number of times per turn, so that the influence of the coil diameter change is reduced, so that the loop current is offset with high accuracy and the coil loss is reduced.

Figure 8:
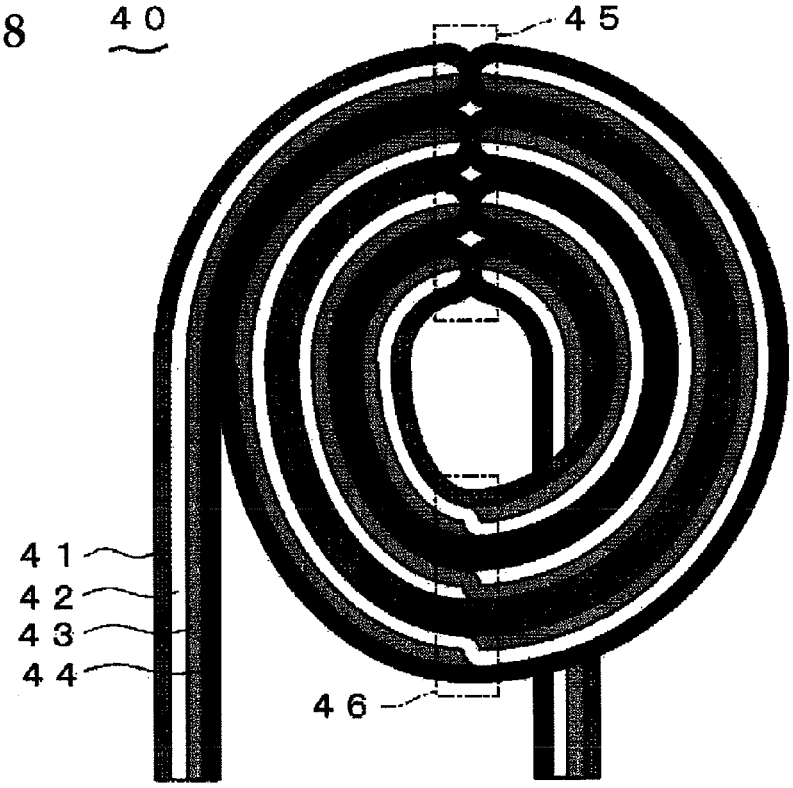
FIG. 8 is a plane view of a plane coil according to a fourth preferred embodiment of the present invention.

FIG. 8 shows a configuration of a plane coil 40 according to a fourth preferred embodiment of the present invention. The plane coil 40 has a configuration that changing positions 45 and 46 of the plural conductive wires 41 to 44 are not lined up each other in addition to the configuration similar to the second preferred embodiment. For example, the two conductive wires 41 and 44 of the four conductive wires 41-44 are changed in the changing position 45 (located in an upper part of the coil in FIG. 8) and the remaining two conductive wires 42 and 43 are changed in the changing position 46 (located in a lower part of the coil in FIG. 8).

When changing the arrangement of all the conductive wire in one position in the plane coil which is formed by winding the considerable parallely-connected conductive wires, a thickness of the plane coil increases in the one position. According to the plane coil 40 of the present preferred embodiment, the changing positions 45 and 46 are not lined up each other appropriately, so that the changing positions are not focused in one position, and an increase of thickness caused by the changing is suppressed minimally.

Figure 9:
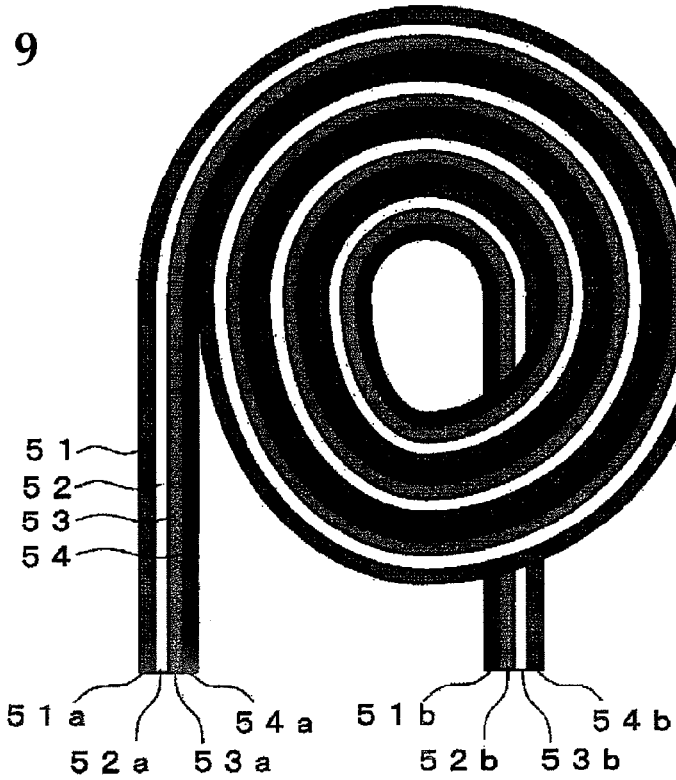
FIG. 9 is a plane view showing a configuration of a conductive wire of a plane coil according to a fifth preferred embodiment of the present invention.
Figure 10:
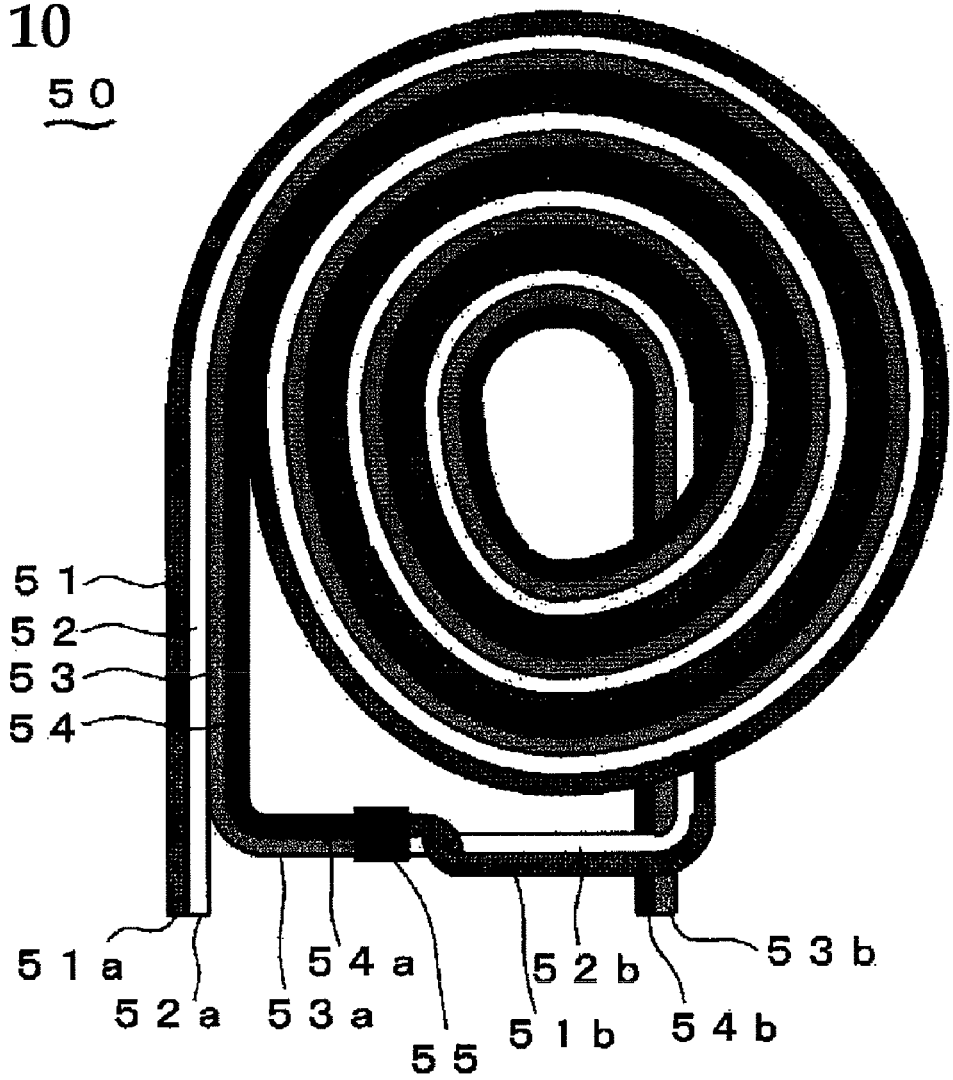
FIG. 10 is a plane coil showing a connection of a conductive wire of the plane coil in FIG. 9.

FIG. 9 shows a configuration of conductive wires 51 to 54 used in a plane coil according to a fifth preferred embodiment of the present invention, and FIG. 10 shows a plane coil 50 of the present preferred embodiment in which the conductive wires 51 to 54 are connected to each other. The plane coil 50 has a configuration that the conductive wires 51 to 54 whose number is an even multiple number of wires connected in parallel are wound number of wires divided a predetermined number of turns by the even number, and the conductive wires whose arrangement of the inner and outer peripheries are different from each other are connected in series at a coil lead-out portion to have the predetermined number of turns, and coil ends of the respective conductive wires are connected to each other in parallel at a coil lead-out portion in addition to the configuration similar to the second preferred embodiment.

As shown in FIG. 9, in a plane coil 50, a predetermined number of turns is set six, and the number of the conductive wires which are connected in parallel is set two, for example. Here, two is selected as an even number, and four conductive wires 51, 52, 53, and 54 which are twice the number of two parallely-connected conductive wires are wound three turns obtained by dividing the predetermined number of turns, that is six, by two. Coil ends 51*a*, 52*a*, 53*a*, and 54*a* of the conductive wires are located in one coil lead-out portion, and coil ends 51*b*, 52*b*, 53*b*, and 54*b* of the conductive wires are located in other coil lead-out portion in the plane coil 50. Next, as shown in FIG. 10, at the coil ends of the conductive wires 51 and 52 and the conductive wires 53 and 54, an arrangement of inner and outer peripheries of the coil ends 52*b* and 53*a* and the coil ends 51*b* and 54*a* are changed and coil ends 52*b*-53*a*, 51*b*-54*a* are connected in series, respectively, to make up the coil. As a result, due to the series connection, the number of turns is added and thereby becomes six (3+3=6), and the number of conductive wires which are connected in parallel becomes two. The coil ends are connected in series in a changing portion 55. Due to the connection in which the arrangement is changed in the plane coil 50 as described above, the currents caused by the loop current flow in opposite directions between the conductive wires 51 and 54 and the conductive wires 52 and 53, so that the current is offset and thereby the loop current does not flow.

Figure 11:
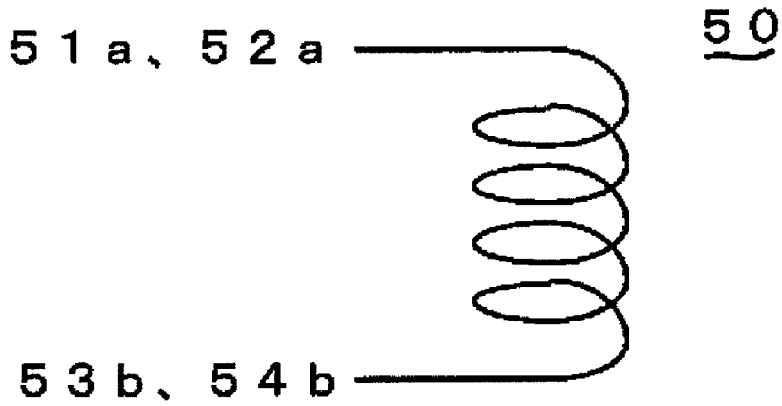
FIG. 11 is an equivalent circuit schematic of the plane coil in FIG. 10.

FIG. 11 shows an equivalent circuit of the plane coil 50. The coil ends 51*a* and 52*a* are electrically connected in one side and the coil ends 53*b* and 54*b* are electrically connected in other side to form the coil between the coil ends.

According to the plane coil 50 of the present preferred embodiment, the arrangement of the conductive wires is changed at the coil lead-out portion, so that it is not necessary to change the arrangement of the conductive wires in the wound coil, and thus the coil can be wound easily and the thin plane coil can be configured easily.

Figure 12A:
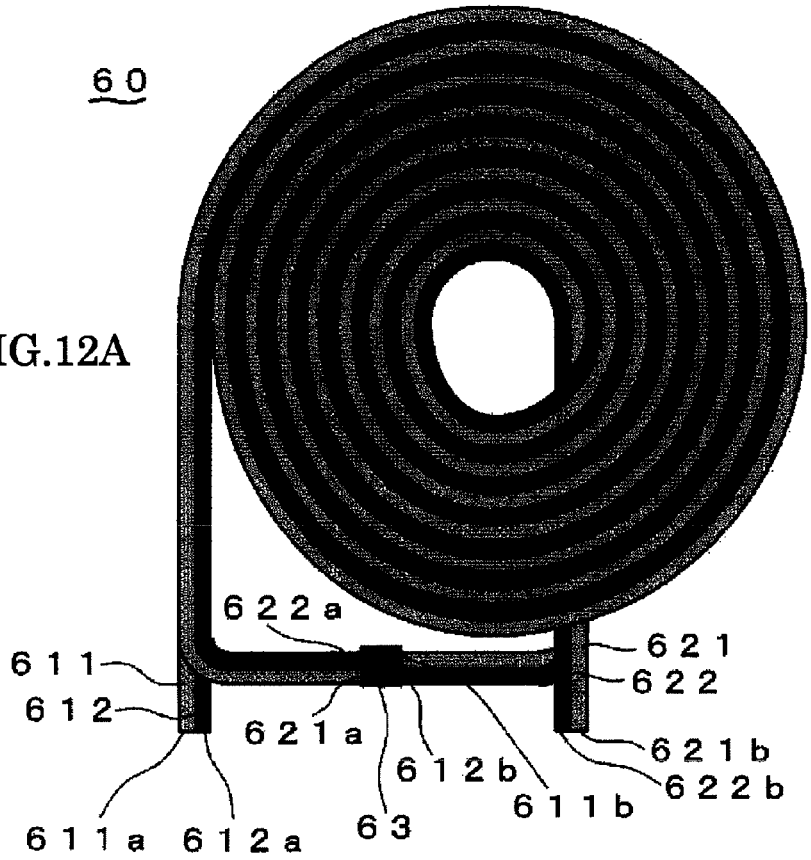
FIG. 12A is a plane view of a plane coil according to a sixth preferred embodiment of the present invention and FIG. 12B is a lateral view of the plane coil in FIG. 12A.
Figure 12B:
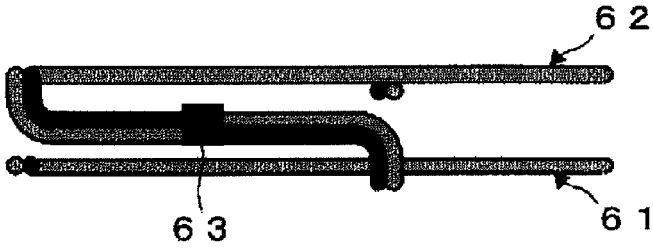

FIGS. 12A and 12B show a configuration of a plane coil 60 according to a sixth preferred embodiment of the present invention. The plane coil 60 has a configuration that even numbers of coils 61 and 62 which have equal coil diameters or equal number of turns at least are stacked, and an arrangement of the conductive wires 611 and 622 and the conductive wires 621 and 622 whose arrangement of inner and outer peripheries are different from each other are changed between the coils 61 and 62 and then those conductive wires are connected in series in addition to the configuration similar to the second preferred embodiment. It is preferable that both the coil diameters and number of turns are equal in the coils 61 and 62 so that the loop current is offset with high accuracy.

In FIGS. 12A and 12B, the conductive wire 611 is wound in an outer periphery and the conductive wire 612 is wound in an inner periphery in the coil 61. The conductive wire 621 is wound in an outer periphery and the conductive wire 622 is wound in an inner periphery in the coil 62. In the conductive wires 611 and 612, coil ends 611*a* and 612*a* on one side are lead-out ends which are lead out from the plane coil 60, and coil ends 611*b* and 612*b* on other side are connection ends which are connected to the coil 62. In the conductive wires 621 and 622, coil ends 621*a* and 622*a* on one side are connection ends which are connected to the coil 62, and coil ends 621*b* and 622*b* on other side are lead-out ends. The connection end 611*b* of the conductive wire 611 on the outer periphery is connected to the connection end 622*a* of the conductive wire 622 on the inner periphery in series in a changing portion 63, and the connection end 612*b* of the conductive wire 612 on the inner periphery is connected to the connection end 621*a* of the conductive wire 621 on the outer periphery in series in the changing portion 63.

Figure 13:
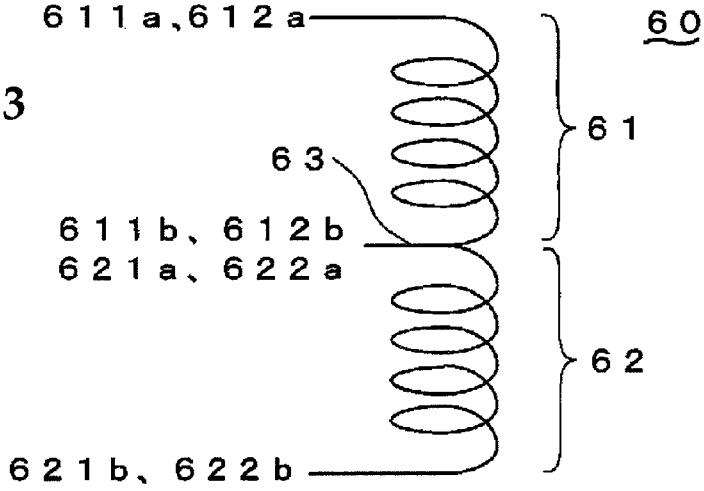
FIG. 13 is an equivalent circuit schematic of the plane coil in FIG. 12A.

FIG. 13 shows an equivalent circuit of the plane coil 60. The lead-out portions 611*a* and 612*a* on the one side are connected to each other in parallel, the lead-out portions 621*b* and 622*b* on the other side are connected to each other in parallel, and the connection ends 611*b*, 612*b*, 621*a*, and 622*a* are connected in series as described above.

As described above, the plane coil 60 according to the present preferred embodiment, the arrangement of the conductive wires 611 and 612 and the conductive wires 621 and 622 whose arrangement of the inner and outer peripheries are different from each other are changed between the coils 61 and 62 and then those conductive wires are connected in series, so that the loop current is offset. Moreover, the arrangement of the conductive wires are changed between the coils 61 and 62, so that it is not necessary to change the arrangement of the conductive wires in the wound coil, and the coil can be wound easily.

The present invention is not limited to the configuration of the above preferred embodiment, however, various modification are applicable within the scope of the invention. For example, the number of conductive wires and the number of coil turns in the respective preferred embodiment are not limited to those shown in the drawings. Moreover, a material other than copper can be used as the conductive material of the conductive wire, and for example, an aluminum wire and an aluminum foil pattern is also applicable.

Moreover, in the above preferred embodiment, a single copper wire can also be used as the conductive wire to wind the plural single copper wires in parallel, or a litz wire can also be used as the conductive wire to wind the plural litz wires in parallel, because they have the similar effect. The single copper wire or the litz wire is appropriately selected as the conductive wire under a condition of a coil thickness due to a form of a product in which the plane coil is used, for example.

Figure 14:
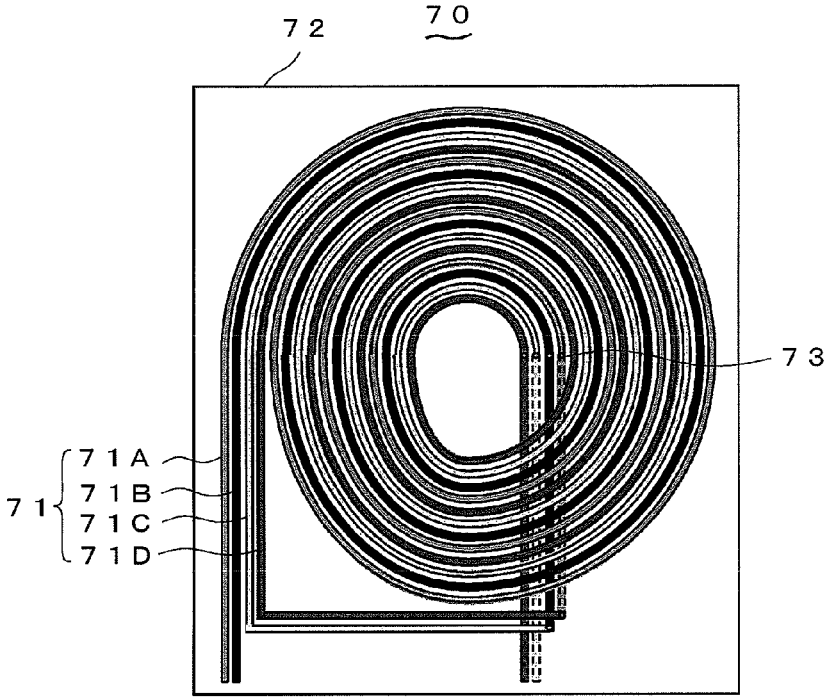
FIG. 14 is a plane view of a plane coil of the present invention in which a copper foil pattern is used for a conductive wire.
Figure 15:
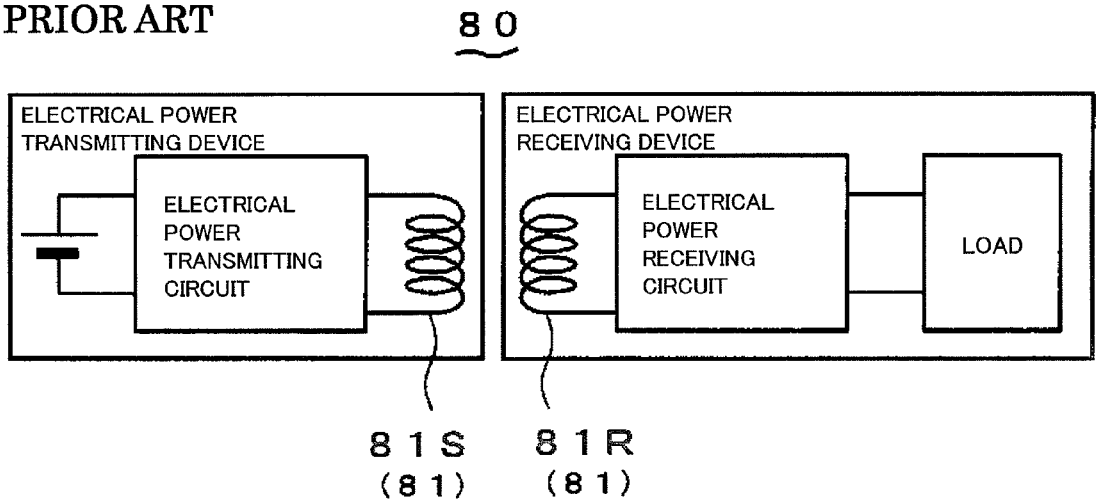
FIG.15 PRIOR ART
FIG. 15 is a configuration diagram of a conventional non-contact power transmission device.
Figure 16A:
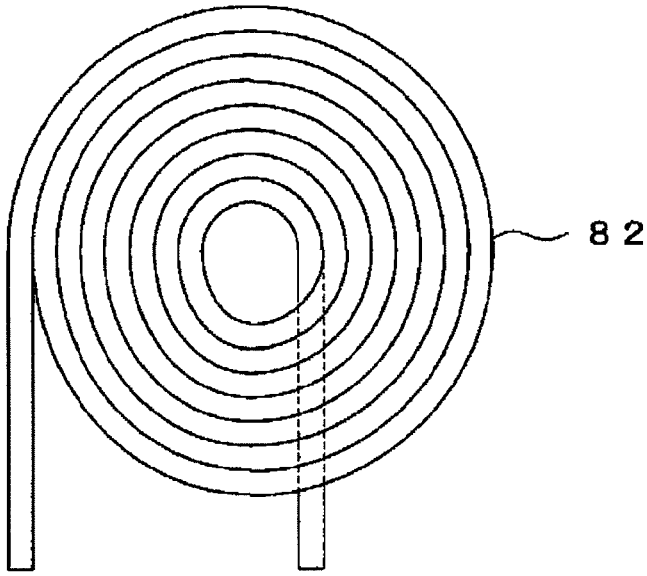
FIG.16A PRIOR ART
FIG. 16A is a plane view of the plane coil in FIG. 15
Figure 16B:
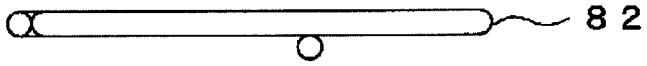
FIG.16B PRIOR ART
FIG. 16B is a lateral view of the plane coil in FIG. 15.
Figure 17:
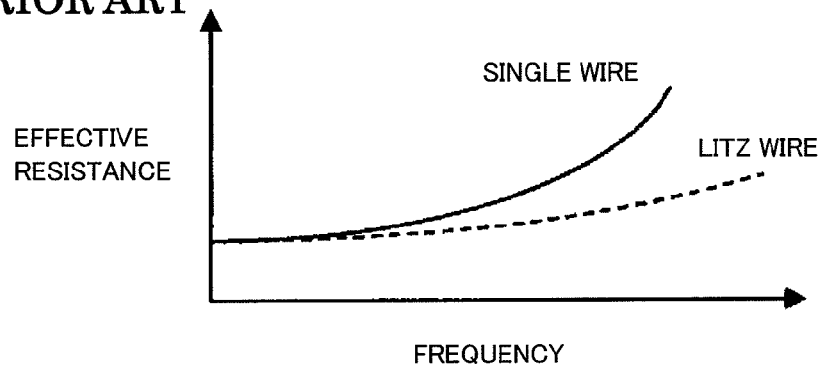
FIG.17 PRIOR ART
FIG. 17 is a diagram showing a general frequency characteristic of an effective resistance of a coil.
Figure 18:
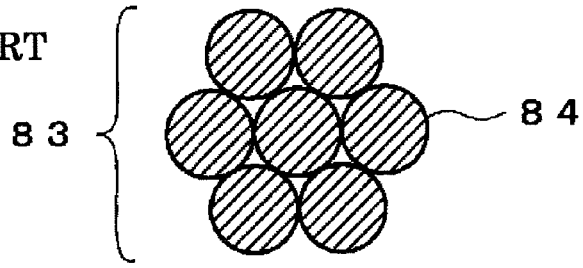
FIG.18 PRIOR ART
FIG. 18 is a cross-sectional view of a litz wire.
Figure 19:
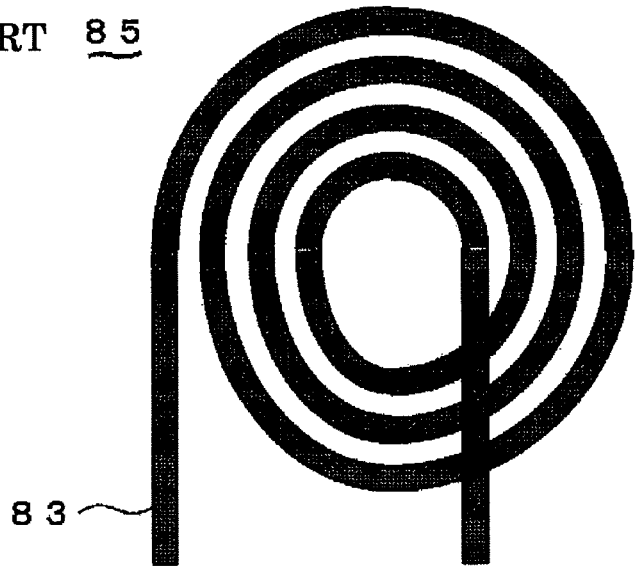
FIG.19 PRIOR ART
FIG. 19 is a plane view of a conventional plane coil using the litz wire.
Figure 20:
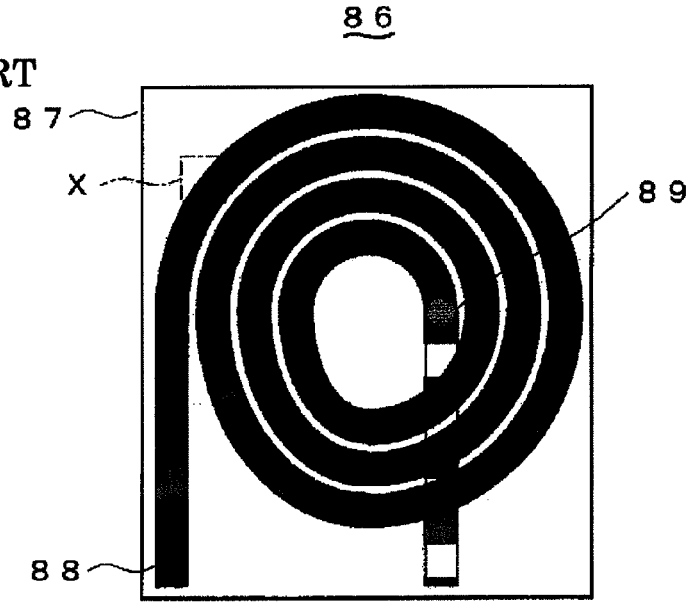
FIG.20 PRIOR ART
FIG. 20 is a plane view of a conventional plane coil using a printed-wiring board.
Figure 21:
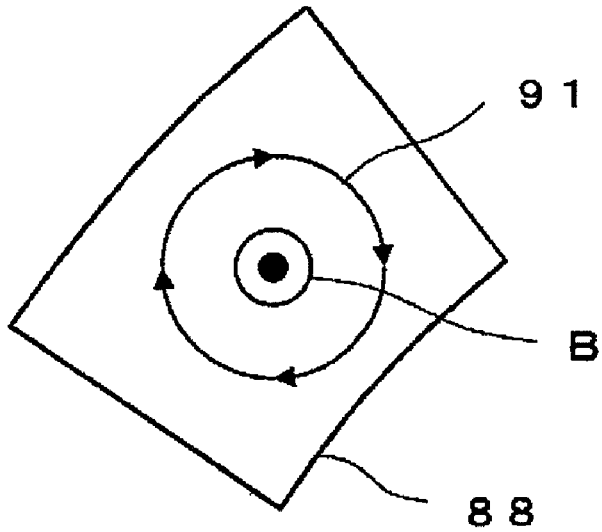
FIG.21 PRIOR ART
FIG. 21 is an enlarged view of an X area in FIG. 20.

Furthermore, the conductive wire can be made up of a copper foil pattern. FIG. 14 shows a configuration of a plane coil 70 in which the conductive wire is the copper foil pattern. In the plane coil 70, the conductive wire is formed as a wiring 71 of the copper foil pattern. A pattern width of each wiring 71 is decreased and plural wirings 71A, 71B, 71C, and 71D are formed on a board 72 to change an arrangement of the wiring 71 and perform a changing when connecting the wirings in a lead-out portion. The plural wirings 71 are connected in parallel, the pattern width of each wiring 71 can be decreased, and an eddy current is reduced. A through hole is provided in the board 72 to pass through one side to other side of the board 72 and connect the wiring 71 on a way of the winding of the wiring 71 (in the wound coil) and in the lead-out portion, and an arrangement of the wiring 71 is changed in the through hole in the coil or in a through hole 73 in the lead-out portion, for example.

The present invention is not limited to the plane coil used in the non-contact power transmission device, however, a plane coil according to the present invention can be used in an AC-DC converter or a non-contact communication device, for example.

Although the present invention is fully described by the preferred embodiments with reference to the accompanying drawings, it is clear to the person having ordinary skill in the art that the various changes and modifications are applicable. Consequently, such changes and modifications do not depart from the scope of the present invention but are to be included in the scope of the present invention.

What is claimed is:

1. A plane coil comprising:

a plurality of conductive wires which are generally parallel to each other, wherein the conductive wires are arranged in a plane and spirally wound, coil ends of the respective conductive wires are electrically connected to each other at a coil lead-out portion such that the conductive wires are connected in parallel, positions of the parallel conductive wires relative to each other are switched at a plurality of changing positions on the plane, the conductive wires have an even number of the conductive wires in parallel in each spiral loop, a first coil comprising a first half of the even number of the conductive wires is stacked vertically adjacent to a second coil comprising a second half of the even number of the conductive wires, the first coil and the second coil have at least one of equal coil diameters and equal numbers of turns, at least one position of the first half of the even number of the conductive wires relative to at least one other position of the first half of the even number of the conductive wires are switched at least one of the plurality of the changing positions on the plane, and the first half of the even number of the conductive wires are connected in series with the second half of the even number of the conductive wires.

2. The plane coil according to claim 1, wherein each of the conductive wires is a copper wire.

3. The plane coil according to claim 2, wherein the copper wire is a litz wire.

4. The plane coil according to claim 1, wherein each of the conductive wires is a copper foil pattern.

* * * * *